US010281128B2

(12) United States Patent
Eggink et al.

(10) Patent No.: US 10,281,128 B2
(45) Date of Patent: May 7, 2019

(54) LIGHTING DEVICE COMPRISING A SPLIT LIGHTING ENGINE

(71) Applicant: SIGNIFY HOLDING B.V., Eindhoven (NL)

(72) Inventors: Hendrik Jan Eggink, Eindhoven (NL); Boudewijn Ruben De Jong, Eindhoven (NL); Marc Andre De Samber, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/575,372

(22) PCT Filed: May 17, 2016

(86) PCT No.: PCT/EP2016/061030
§ 371 (c)(1),
(2) Date: Nov. 19, 2017

(87) PCT Pub. No.: WO2016/184859
PCT Pub. Date: Nov. 24, 2016

(65) Prior Publication Data

US 2018/0156440 A1 Jun. 7, 2018

(30) Foreign Application Priority Data

May 19, 2015 (EP) ..... 15168154

(51) Int. Cl.
*F21V 29/10* (2015.01)
*F21S 4/20* (2016.01)
(Continued)

(52) U.S. Cl.
CPC ..... *F21V 29/10* (2015.01); *F21K 9/232* (2016.08); *F21K 9/238* (2016.08); *F21K 9/90* (2013.01); *F21S 4/20* (2016.01); *F21V 23/005* (2013.01); *F21V 23/02* (2013.01); *H05B 33/0827* (2013.01); *H05B 33/0851* (2013.01);
(Continued)

(58) Field of Classification Search
CPC ..... F21V 29/10; F21K 9/238; F21K 9/232; F21K 9/90
See application file for complete search history.

(56) References Cited

U.S. PATENT DOCUMENTS 6,933,707 B2 8/2005 Allen
8,604,716 B2 12/2013 Ito et al.
(Continued)

FOREIGN PATENT DOCUMENTS

CN 102595707 A 7/2012
CN 103104850 A 5/2013
(Continued)

*Primary Examiner* — Anne M Hines
(74) *Attorney, Agent, or Firm* — Akarsh P. Belagodu

(57) ABSTRACT

The present invention relates to a lighting device (100, 200, 300) comprising a split lighting engine with at least two thermally separated sub-engines (104, 106, 202, 204, 206, 302). Each sub-engine comprises at least one solid state light source (114, 212, 306) and a component (118, 210, 304) adapted to regulate electric current or power to the at least one solid state light source (114, 212, 306), so that the sub-engines (104, 106, 202, 204, 206, 302) are individually drivable based on a thermal environment of each sub-engine.

10 Claims, 3 Drawing Sheets

(51) Int. Cl.

| | |
|---|---|
| ***F21K 9/232*** | (2016.01) |
| ***F21K 9/90*** | (2016.01) |
| ***F21K 9/238*** | (2016.01) |
| ***F21V 23/00*** | (2015.01) |
| ***F21V 23/02*** | (2006.01) |
| ***H05B 33/08*** | (2006.01) |
| *F21V 29/503* | (2015.01) |
| *F21Y 115/10* | (2016.01) |
| *F21Y 107/30* | (2016.01) |
| *F21Y 107/40* | (2016.01) |

(52) U.S. Cl.

CPC ..... *F21V 29/503* (2015.01); *F21Y 2107/30* (2016.08); *F21Y 2107/40* (2016.08); *F21Y 2115/10* (2016.08)

(56) References Cited

U.S. PATENT DOCUMENTS

| | | | | |
|---|---|---|---|---|
| 8,779,685 | B2 | 7/2014 | Wang | |
| 8,803,428 | B2 | 8/2014 | Tseng et al. | |
| 2008/0259603 | A1 | 10/2008 | Kraus | |
| 2009/0179843 | A1 | 7/2009 | Ackermann et al. | |
| 2010/0219758 | A1* | 9/2010 | Melzner ..... | F21K 9/00 315/113 |
| 2011/0068701 | A1 | 3/2011 | Van De Ven et al. | |
| 2013/0154489 | A1 | 6/2013 | Chang et al. | |
| 2013/0193851 | A1 | 8/2013 | Alon et al. | |

FOREIGN PATENT DOCUMENTS

| | | | |
|---|---|---|---|
| DE | 102008038857 | A1 | 10/2009 |
| DE | 202010000890 | U1 | 5/2010 |

* cited by examiner

LIGHTING DEVICE COMPRISING A SPLIT LIGHTING ENGINE

CROSS-REFERENCE TO PRIOR APPLICATIONS

This application is the U.S. National Phase application under 35 U.S.C. § 371 of International Application No. PCT/EP2016/061030, filed on May 17, 2016, which claims the benefit of European Patent Application No. 15168154.1, filed on May 19, 2015. These applications are hereby incorporated by reference herein.

TECHNICAL FIELD OF THE INVENTION

The present invention relates to lighting devices.

BACKGROUND

Traditional incandescent lighting devices are currently being replaced by more energy efficient alternatives, such as halogen lighting devices and light emitting diode (LED) lighting devices. It is important to balance the desire for the lighting device to provide a large amount of light, and the amount of heat produced by components of the lighting device during use. For example, LEDs generate heat during operation due to the imperfect conversion from electrical energy to light. The heat will raise the temperature of the LEDs. As there is a limit to how much heat and temperature an LED can handle before breaking down or severely shortening the lifetime of the LED, there is also a need to handle the heat generated. Solutions for handling the heat exist, such as including heat sinks for storing the heat, and/or heat conductors which transport the heat to an enclosure, e.g. an envelope in an LED bulb, and allows a larger area to dissipate the heat to the ambient environment. Another solution is to limit the current based on the temperature. For example, U.S. Pat. No. 8,803,428 discloses an LED apparatus which includes several parallel pairs of serially connected current-limiting devices and LEDs in FIG. 4 of U.S. Pat. No. 8,803,428 to limit the current to the LEDs to avoid abnormal temperatures.

SUMMARY

It is a general object of the present invention to provide an improved lighting device which may, at least partly, alleviate the above mentioned drawbacks.

According to a first aspect of the present invention, this and other objectives are achieved by a lighting device comprising a split lighting engine with at least two thermally separated sub-engines. Each sub-engine comprises at least one solid state light source, and a component adapted to regulate electric current or power to the at least one solid state light source, so that the sub-engines are individually drivable based on a thermal environment of each sub-engine.

The present invention is based on the realization that splitting the lighting engine into at least two thermally separated sub-engines allows an increase of the total heat dissipation of the lighting engine, compared to a single larger lighting engine, due to e.g. changes in geometry and thermal environment. The increased heat dissipation allows more power to be applied to the lighting engine, which in turn enables the lighting engine to generate more light. The thermal separation of the sub-engines provides each sub-engine with a thermal environment. For example, the distance to other components of a lighting device such as e.g. an envelope or socket may provide different thermal environments for each sub-engine, variation in the solid state light sources at the time of assembly or their degradation over time may also cause each sub-engine to, in use, generate different amounts of heat. The component adapted to regulate electric current or power to the at least one solid state light source, enables the sub-engines to be individually drivable based on the thermal environment of each sub-engine. Hence, each sub-engine can, in use, operate at a maximum temperature and light output. For example, one sub-engine may provide more power to the at least one solid state light source than the other sub-engine(s). The present invention provides a lighting device which may prolong the lifetime of the components therein, and enables the lighting engine to generate more light.

In one embodiment of the invention, each sub-engine may comprise a plurality of components adapted to regulate the electric current or power to the at least one solid state light source. The component adapted to regulate electric current or power to the at least one solid state light source may comprise one or more sub-components. The component adapted to regulate electric current or power to the at least one solid state light source may be integrated in the at least one solid state light source. For example, the component may comprise a temperature sensor and an integrated circuit (IC) which regulates the electric current or power to the at least one solid state light source. The at least one solid state light source may be integrated on the IC.

In order to provide the thermal separation between the sub-engines, each sub-engine may be spaced apart from other sub-engines by a predetermined distance. The predetermined distance may be at least 5 mm. The predetermined distance may be larger than 5 mm, such as 6-8 mm or 8-10 mm or 10-25 mm. The space formed between the sub-engines may comprise a suitable material or gas with low thermal conductivity. Suitable materials and gases may be air, helium, glass, or a thermoplastic, such as ABS, PLA or polycarbonate (PC).

In one embodiment of the invention, the lighting device may further comprise driver circuitry connected to each sub-engine for driving the at least one solid state light source. Driver circuitry common to the sub-engines may be placed at a distance from the sub-engines to provide a thermal separation between the driver circuitry and the sub-engines.

In another embodiment of the invention, each sub-engine may comprise driver circuitry for driving the at least one solid state light source. By including driver circuitry in the sub-engines, a simple power line is enough to provide power to each sub-engine. Further, the sub-engines may operate independently of each other.

In one embodiment of the invention, the component is a passive component adapted to passively regulate electric current or power to the at least one solid state light source. Using a component which passively regulates electrical current or power to the at least one solid state light source allows tuning of the sub-engines to predetermined or known thermal conditions of the lighting device at the time of product design, assembly or manufacturing the lighting device. The component adapted to passively regulate electric current or power may be a resistor connected in series with the at least one solid state light source.

In another embodiment of the invention, the component is an active component adapted to actively regulate electric current or power to the at least one solid state light source. Using a component which actively regulates the electric current or power, e.g. a component with a temperature dependence such that the current or power provided to the at least one solid state light source decreases with an increasing temperature, enables the sub-engines to, in use, adjust the current or power provided to the at least one solid state light source. Thereby, each sub-engine may adapt and operate at a maximum temperature and light output based on the present thermal environment. An additional advantage is that a thermal runaway of the sub-engines may be prevented as the electric current or power provided to the at least one solid state light source is reduced if the temperature increases. The component adapted to actively regulate electric current or power to the at least one solid state light source may be a temperature sensitive resistor with a positive temperature coefficient and is connected in series with the at least one solid state light source. As an alternative, the component may be a temperature sensitive resistor with a negative temperature coefficient and is connected in parallel with the at least one solid state light source, e.g. the temperature sensitive resistor with a negative temperature coefficient acts as a bleeder. As a further alternative, the component adapted to regulate electrical current or power may be a current limiting diode connected in series with the at least one solid state light source.

In one embodiment of the invention, the lighting device may further comprise an envelope, and the sub-engines may be arranged within the envelope along an optical axis of the lighting device. Each sub-engine may comprise a substrate arranged parallel to the optical axis of the lighting device. The at least one solid state light source may be mounted on the substrate. Hence, the sub-engines are thermally separated from each other within the envelope of the lighting device. The heat transfer from the sub-engines to the envelope may be a combination of convective gas flow and thermal radiation. Hence, the distance to the envelope and the orientation affects the thermal environment for the sub-engines.

In another embodiment of the invention, the lighting device may further comprise a shell made by additive manufacturing at least partially enclosing the sub-engines. Additive manufacturing provides artists and designers with the possibility to choose new shapes and form when designing lighting devices with embedded or enclosed sub-engines. Depending on the level of embedding, e.g. the thickness of material between the sub-engine and the ambient environment, each sub-engine may experience a different thermal environment.

In embodiments of the invention, the lighting device may be a light bulb or a luminaire. In a light bulb or luminaire the sub-engines may experience different thermal environments based on their position within the light bulb or luminaire and the number of neighboring sub-engines. For example, a sub-engine surrounded by other sub-engines in the light bulb or luminaire may not be able to provide the at least one solid state light source with as much power as a sub-engine arranged with fewer neighboring sub-engines.

According to a second aspect of the present invention, a method for operating a lighting device is also provided. The lighting device comprises a split lighting engine with at least two thermally separated sub-engines, and each sub-engine comprises at least one solid state light source. The method comprises regulating electric current or power to the at least one solid state light source, to individually drive the sub-engines based on a thermal environment of each sub-engine.

This second aspect may have the same or similar features and advantages as mentioned above with regard to the first aspect and vice versa. In order to regulate the electric current or power to the at least one solid state light source, the lighting device may further comprise means for regulating the electric current or power to the at least one solid state light source. The means for regulating the electric current or power to the at least one solid state light source may be the aforementioned component adapted to regulate electric current or power to the at least one solid state light source described in connection with the first aspect. Alternatively, the means for regulating the electric current or power to the at least one solid state light source may be a dual driver circuitry which may have programmable setting of electrical current, pulse width modulation (PWM), and a voltage divider etc in order to provide and adapt the electric current or power to the sub-engines. Hence, the dual driver circuitry may comprise multiple driving stages, e.g. one stage which performs the AC-DC conversion for all sub-engines of the lighting engine, and specific stages which perform the DC-DC conversion for each sub-engine to regulate the electric current or power to each sub-engine. As another alternative, the lighting device may comprise a single driver circuitry connected to each sub-engine, and the means for regulating electric current or power may be provided by electronic switches rather than electronic dissipating elements comprised in the sub-engines. Thereby, less power is converted into heat as the switch may more efficiently regulate the electric current or power to the at least one solid state light source. The electronic switches should preferably be able to provide gradual control of the power to the at least one solid state light source. The electronic switch may be a MOSFET or another type of transistor.

According to a further aspect of the present invention, a method for determining the orientation of a lighting device is also provided. The lighting device comprises a split lighting engine with at least two thermally separated sub-engines. Each sub-engine comprises at least one solid state light source, and a temperature sensor arranged on each sub-engine to measure the temperature of the sub-engine. The lighting device further comprises means for regulating electric current or power to the at least one solid state light source, so that the sub-engines are individually drivable based on their thermal environment, and an envelope, and the sub-engines are placed within the envelope along an optical axis of the lighting device. The method comprises the steps of applying a substantially equal amount of power to each sub-engine, and the step of measuring the temperature of each sub-engine to provide temperature data for each sub-engine. The method further comprises determining the orientation of the lighting device based on the temperature data from each sub-engine and their respective placement along the optical axis.

This further aspect may provide the same or similar advantages as mentioned above with regard to the first or second aspect. The further aspect also enables the determination of the orientation of a lighting device without providing an orientation sensor in the form of an accelerometer, gyroscope or the like. The means for regulating the electric current or power to the at least one solid state light source may be the aforementioned component adapted to regulate electric current or power to the at least one solid state light source described in connection with the first aspect. Alternatively, the means for regulating the electric current or power to the at least one solid state light source may be a dual driver circuitry which may have programmable setting of electrical current, pulse width modulation (PWM), and a voltage divider etc in order to provide and adapt the electric current or power to the sub-engines. Hence, the dual driver circuitry may comprise multiple driving stages, e.g. one stage which performs the AC-DC conversion for all sub-engines of the lighting engine, and specific stages which perform the DC-DC conversion for each sub-engine to regulate the electric current or power to each sub-engine. As another alternative, the lighting device may comprise a single driver circuitry connected to each sub-engine, and the means for regulating electric current or power may be provided by electronic switches rather than electronic dissipating elements comprised in the sub-engines. Thereby, less power is converted into as the switch may more efficiently regulate the electric current or power to the at least one solid state light source. The electronic switches should preferably be able to provide gradual control of the power to the at least one solid state light source. The electronic switch may be a MOSFET or another type of transistor.

The method may further comprise a step of adapting the power applied to each sub-engine such that they reach the same temperature. Thus, an additional advantage is that the power applied to each sub-engine may be adapted based on the orientation of the lighting device. For example, a sub-engine located in an upper part of the lighting device may get hotter than a sub-engine located in a lower part during use, and may receive less power due to the orientation of the lighting device.

Further features of, and advantages with, the present invention will become apparent when studying the appended claims and the following description. The skilled person realizes that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing different embodiments of the invention.

All the figures are schematic, not necessarily to scale, and generally only show parts which are necessary in order to elucidate the embodiments, wherein other parts may be omitted or merely suggested like reference numerals refer to like elements throughout the description.

DETAILED DESCRIPTION OF THE DRAWINGS

In the present detailed description, embodiments of a lighting device according to the present invention are mainly discussed with reference to schematic views showing lighting devices according to different embodiments of the invention. It should be noted that this by no means limits the scope of the invention, which is also applicable in other circumstances for instance with other types or variants of lighting devices than the embodiments shown in the appended drawings. Further, that specific components are mentioned in connection to an embodiment of the invention does not mean that those components cannot be used to an advantage together with other embodiments of the invention. The invention will now be described with reference to the enclosed drawings where first attention will be drawn to the structure, and secondly to the function.

Figure 1:
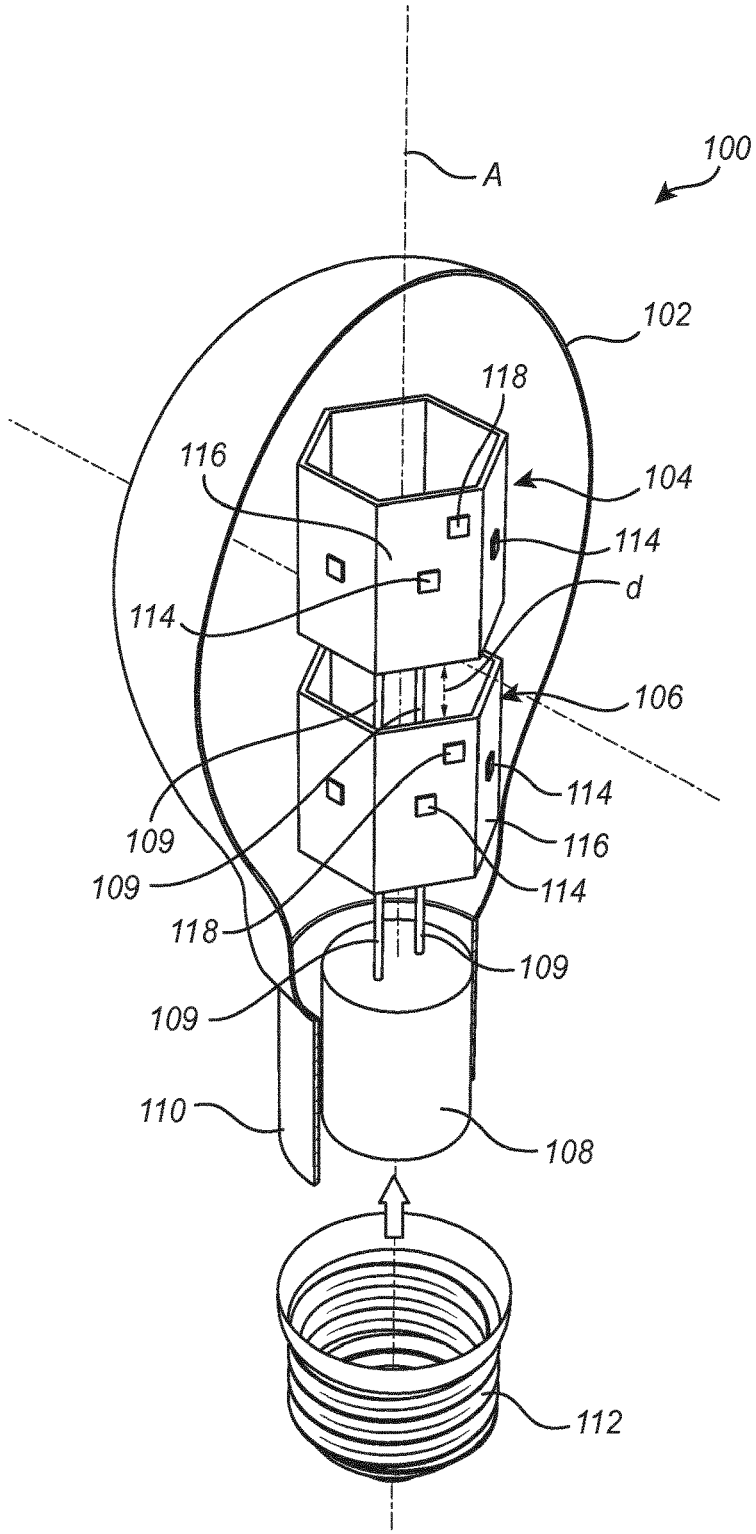
FIG. 1 is a perspective view of a lighting device according to one embodiment of the invention.

FIG. 1 shows a perspective view of a lighting device 100 according to an embodiment of the invention. It will be appreciated that the examples of various features of the lighting device 100 described with reference to FIG. 1 are combinable with other embodiments described hereinafter with reference to the appended drawings.

The lighting device 100 has a shape and design imitating the traditional incandescent bulb. The lighting device 100 may also be referred to as a light bulb. The lighting device 100 comprises an envelope 102. The envelope 102 is transparent or translucent to allow light emitted from solid state light sources 114 within the envelope to pass through. The envelope 102 can be made of glass or plastic. The envelope 102 comprises a base portion 110 towards one end. The lighting device 100 has an optical axis A which extends along the longitudinal direction of the lighting device 100 and of the envelope 102.

The lighting device 100 further comprises a split lighting engine comprising two thermally separated sub-engines, a first sub-engine 104 and a second sub-engine 106, arranged within the envelope 102 along the optical axis A. The first and second sub-engine 104, 106 are spaced apart by a distance d to provide a thermal separation. The distance d is typically 5 mm. The distance d may also vary in order to achieve a thermal separation, for example in the range 5-25 mm.

The first and second sub-engines 104, 106 each comprise a substrate 116. The substrate 116 is a single piece which is folded in sections to form a polygonal shape. The substrate 116 is arranged parallel to the optical axis A, and forms an elongated polygon along the optical axis A. The substrate may be formed by a flexible foil which is curved to form the elongated polygon, or a wire-frame which is shaped into the elongated polygon. The substrate may of course also be configured with another shape, typically to form cylinder, or substantially cylindrical shape, along the optical axis A. Alternatively, the substrate 116 may comprise a plurality of flat substrates 116 connected to each other via suitable fastening means such as glue, a weld or snap connection etc to form an elongated polygon along the optical axis A.

The first and second sub-engines 104, 106 further comprise solid state light sources 114. The solid state light sources 114 are mounted on the substrates 116, preferably using conventional techniques, like surface-mount technology (SMT). A main or central light emitting direction of the light sources is perpendicular to the substrate 116. The substrates 116 can comprise electrical connections for the solid state light sources 116 and other components. The substrates 116 may for example be printed circuit boards (PCB) of any kind, with electrically conductive tracks or segments.

The solid state light sources 114 are mounted on the substrate 116 facing the envelope 102, and connected to the electrically conductive tracks or segments (not shown) of the substrate 116. The solid state light sources 114 are arranged to emit light in directions away from the substrate 116 through the envelope 102. The solid state light sources 114 may be any kind of solid state light sources, such as light emitting diodes (LED), OLEDs, PLEDs or the like. LEDs should be broadly interpreted as LED dies, packaged LEDs or LED subassemblies.

The first and second sub-engine 104, 106 further comprises a component 118, mounted on the substrate 116, and adapted to regulate electric current or power to the solid state light sources 114 of each sub-engine. It is of course also possible that the each sub-engine 104, 106 comprises more than one component 118 although not explicitly shown. The component 118 may also be integrated as a part of the solid state light source 114. There are several alternatives available to implement such a component 118. For example, the component 118 may be a passive electrical component such as a resistor connected in series with the solid state light sources 114. This allows the electrical current to be adapted for each sub-engine for example based on their predetermined and known distance to the envelope 102 e.g. at the time of manufacturing the lighting device 100.

Alternatively, the component 118 may be a temperature sensitive resistor with a positive or negative temperature coefficient, connected in series or parallel to the solid state light sources 114. Another alternative is to connect a current limiting diode in series with the solid state light sources 114, and use the temperature dependence of the current limiting diode. Active components allows the sub-engines 104, 106 to adjust the electrical current provided to the solid state light source 114 based on the temperature of the thermal environment of the first and second sub-engine 104, 106 during operation of the lighting device 100.

The component 118 mounted to the first and second sub-engine 104, 106 in FIG. 1 is a temperature sensitive resistor with positive temperature coefficient connected in series with the solid state light sources 114 of each sub-engine.

It should of course be noted that the first sub-engine 104 may comprise a different component 118 than the second sub-engine 106. The same reference number is used for the components 118 of the first and second sub-engine 104, 106 for the sake of brevity and does not imply that different combinations or permutations of the above mentioned components 118, e.g. different types of resistors, may not be used to advantage with the present invention.

The lighting device 100 further comprises driver circuitry 108. The driver circuitry 108 may be arranged within the envelope 102. In general, the driver circuitry 108 should be understood to be circuitry capable of converting electricity from mains to electricity suitable to drive the solid state light sources 114. Therefore, the driver circuitry 108 is typically capable of at least converting AC to DC and to a suitable voltage for driving the solid state light sources 114. The driver circuitry 108 is connected to the sub engines via wires 109. The wires 109 can also support the first and second sub-engine 104, 106 within the envelope 102. Alternatively, the first and second sub-engine 104, 106 may be supported within the envelope 102 by being fastened to a pump tube or stem (not shown).

The lighting device 100 further comprises a cap 112 for electrical and mechanical connection to lamp socket (not shown). The cap 112 may be arranged around the outside of the base portion 110 of the envelope 102 as indicated by the arrow in FIG. 1. The cap 112 is connected to driver circuitry 108 in order to supply electrical power from mains to the driver circuitry 110. The cap 112 may also be referred to as a fitting or end cap. Here, the cap 112 is a single base. The cap 112 may for example, and as shown, be a screw base having an external thread e.g. Edison screw base. However, the cap 112 could also have a different shape and form, such a bayonet or bi-pin etc.

In use, the lighting device 100 is connected to e.g. mains electricity via the cap 112. The driver circuitry 108 converts the electricity from e.g. AC to DC and a voltage suitable for driving the solid state light sources 114. The first and second sub-engines 104, 106 are both supplied with electrical current from the driver circuitry 108, and the solid state light sources 114 emit light. The temperature within the envelope 102 increases as e.g. the solid state light sources 114 generate heat while emitting light. The resistance of the temperature sensitive resistor 118 of the first sub-engine 104 increases with an increasing temperature such that the current and power provided to the solid state light sources 114 of the first sub-engine 104 decreases, which in turn means that the solid state light sources 114 of the first sub-engine 104 generates less heat. The same situation applies to the second sub-engine 106 although the first and second sub-engine 104, 106 experiences different thermal environments depending on their distance to the envelope 102 and e.g. the orientation of the lighting device 100. Through the use of the temperature sensitive resistor 118 which restrict the electrical current to the solid state light sources 114, the first and second sub-engines 104, 106 adapts to a steady-state operating point, e.g. a maximum temperature and light output.

Figure 2:
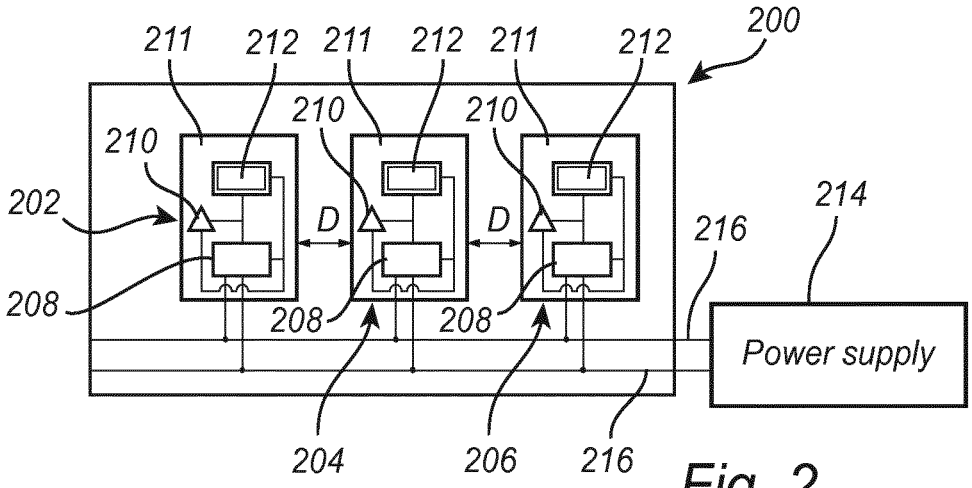
FIG. 2 is a planar view of a lighting device according to another embodiment of the invention.

FIG. 2 shows a perspective view of a lighting device 200 according to another embodiment of the invention. The lighting device 200 may be a luminaire, in which three sub-engines 202, 204, 206 are arranged. A first, sub-engine 202, a second sub-engine and a third sub-engine 206. The three sub-engines 202, 204, 206 are arranged in an array and separated from each other by a distance D which provides a thermal separation between the three sub-engines 202, 204, 206. The distance D is typically 5 mm. The distance D may vary in order to achieve a thermal separation, for example in the range 5-25 mm. Note that the second sub-engine 204 is positioned between the first and the third sub-engine 202, 206 and due to the proximity to both also receives heat from both the first and the third sub-engine 202, 206. It is of course possible to arrange sub-engines in a matrix, i.e. in a two-dimensional array, in the luminaire where sub-engines may by surrounded at four sides by other sub-engines.

The sub-engines 202, 204, 206 comprise a solid state light source 212, a component 210 adapted to regulate electric current or power to the at least one solid state light source 212, and driver circuitry 208 for the solid state light source 212 of the sub-engine. The sub-engines 202, 204, 206 also comprise a substrate 211 which supports the solid state light source 212, the component 210, and the driver circuitry 208. The substrates 211 can comprise electrical connections for the solid state light sources 212. The substrates 211 may for example be printed circuit boards (PCB) of any kind, with electrically conductive tracks or segments.

Note that a difference to the lighting device 100 shown in FIG. 1 is that each sub-engine 202, 204, 206 comprises driver circuitry 208. The driver circuitry 208 of each sub-engine is connected to a power supply 214 via wires 216. The power supply 214 can be mains electricity. The wires 216 may be a common rail or the like arranged in the luminaire 200.

The component 210 adapted to regulate electric current or power to the at least one solid state light source can be any one of the alternatives described above in conjunction with FIG. 1. The component 210 mounted to the first, second and third sub-engine 202, 204, 206 in FIG. 2 is a temperature sensitive resistor with a negative temperature coefficient connected in parallel with the solid state light sources 212 of each sub-engine. That the component 210 is a temperature sensitive resistor with a negative temperature coefficient connected in parallel with the solid state light sources 212 of each sub-engine is only provided as an example. The skilled addressee also realizes that other possibilities, for example a connection in series with the other types of component are possible. Further, each sub-engine 202, 204, 206 may have a different component 210 and thus be connected differently than the other sub-engines 202, 204, 206.

In use, the driver circuitry 208 of each sub-engine converts the electricity supplied from the power supply 214 from e.g. AC to DC and a voltage suitable for driving the solid state light sources 212. The solid state light sources 212 emit light and generate heat which causes the temperature within the luminaire 200 to increase. The resistance of the temperature sensitive resistor 210 decreases with an increasing temperature such that the electrical current provided to the solid state light sources 212 of the first sub-engine 202 decreases, the temperature sensitive resistor 210 thereby acts as a bleeder. The decreasing electrical current provided to the solid state light source 210 means that the solid state light source 210 generates less heat and light. The first, second and third sub-engines 202, 204, 206 experience different thermal environments based on their distance to the luminaire 200, the interaction between the sub-engines as noted above, and the distance D between the sub-engines 202, 204, 206. Hence, the first, second and third sub-engines 202, 204, 206 can each provide different amounts of power to their respective solid state light sources 212 in order to reach a steady-state operating point, e.g. a maximum temperature and light output based on the thermal environment for each sub-engine 202, 204, 206.

Figure 3:
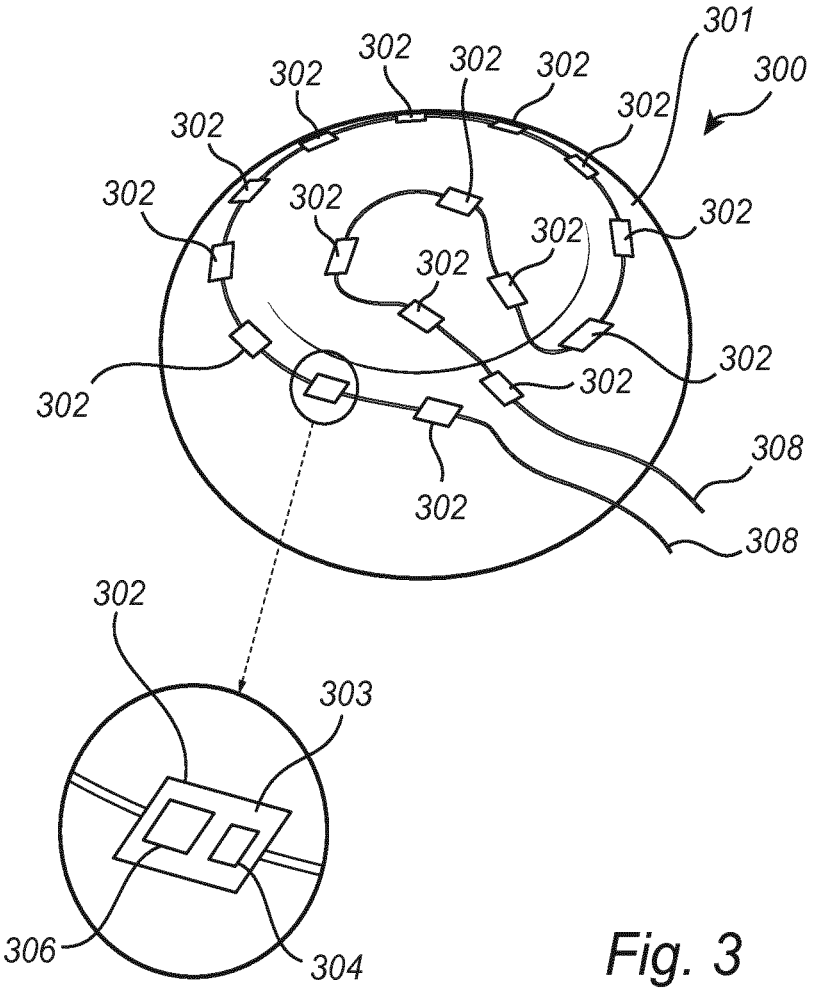
FIG. 3 is a perspective view of a lighting device according to yet another embodiment of the invention.

FIG. 3 shows a perspective view of a lighting device 300 according to yet another embodiment of the invention. The lighting device 300, which may be referred to as a (additive manufactured) luminaire, comprises a plurality of connected sub-engines 302 and an additively manufactured shell 301. The additively manufactured shell 301 at least partially encloses the plurality of connected sub-engines 302. The sub-engines 302 comprises a substrate 303, a solid state light source 306, and a component 304 adapted to regulate the electric current or power to the solid state light source 306. The substrate 303, solid state light source 306, and component 304 can be the same alternatives as described above in conjunction with FIGS. 1 and 2. Alternatively, the substrates 303 may not be included in the lighting device 300, and the solid state light source 306 and the component 304 may then be arranged directly on the additively manufactured shell 301.

The sub-engines 302 are supplied with electrical current via wires 308 which can be connected to an external driver circuitry (not shown) which converts the electricity in mains from e.g. AC to DC and a voltage suitable for driving the solid state light sources 308. As an alternative, driver circuitry can also be enclosed in the additively manufactured shell 301.

The additively manufactured shell 301 can be made of a thermoplastic such as PLA, PC or ABS. As ABS, PC and PLA have low thermal conductivity, each sub-engine 302 becomes thermally separated from the other sub-engines of the lighting device 300. The thermal environment of each sub-engine 302 depends on the distance from the sub-engine 302 to the ambient environment, e.g. the level of embedding. Hence, a deeply embedded sub-engine 302 receives less thermal interaction, e.g. cooling, than a sub-engine 302 embedded closer to the surface of the additively manufactured shell 301.

In use, the sub-engines 302 are provided with power via the wires 308, and the solid state light source 306 mounted on each sub-engine 302 emit light and generate heat. The temperature of each sub-engine 302 increases as well as the temperature of the surrounding material of the additively manufactured shell 301. The component 304 adapts the current or power, by any of the previously described mechanisms, provided to the solid state light source 306 such that the sub-engines 302 reach a steady-state operating point, e.g. a maximum temperature and light output, based on each sub-engines 302 thermal environment.

Figure 4:
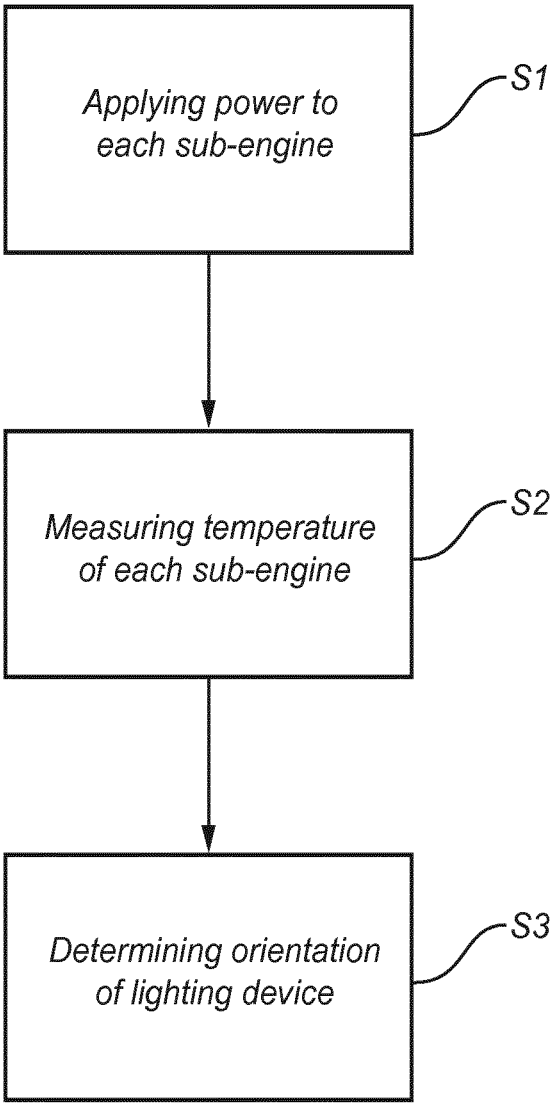
FIG. 4 is a flow chart showing steps of a method for determining the orientation of a lighting device according to another embodiment of the present invention.

FIG. 4 shows a flowchart of a method for determining the orientation of a lighting device. The lighting device used for the method shown in FIG. 4 is largely similar to the lighting device 100 shown in FIG. 1 with the addition of a temperature sensor arranged on each sub-engine 104, 106 and the possibility to use a dual driver circuitry instead of the component on each sub-engine 104, 106. Therefore, references to the lighting device 100 will be used in the following to describe a lighting device where the method may be implemented. Hence, such a lighting device 100 comprises a split lighting engine with at least two thermally separated sub-engines 104, 106. Each sub-engine comprises at least one solid state light source 114, and a temperature sensor (not shown) arranged on each sub-engine 104, 106 to measure the temperature of the sub-engine. The lighting device may further comprises means for regulating electric current or power to the at least one solid state light source 114, so that the sub-engines 104, 106 are individually drivable based on their thermal environment. The lighting device 100 further comprises an envelope 102, and the sub-engines 104, 106 are placed within the envelope 102 along an optical axis A of the lighting device 100.

A first step S1 of the method comprises applying a substantially equal amount of power to each sub-engine 104, 106.

A second step S2 of the method comprises measuring the temperature of each sub-engine 104, 106, to provide temperature data for each sub-engine 104, 106.

In a third step S3 the orientation of the lighting device 100 is determined based on the temperature data from each sub-engine 104, 106, and the placement of the sub-engines 104, 106 along the optical axis A. For example, that the first sub-engine 104 has a higher temperature than the second sub-engine 106 may indicate that the first sub-engine 104 is located above the second sub-engine 106 and that the lighting device 100 is in an upright position.

The means for regulating electric current or power to the at least one solid state light source 114 may be the component 118 discussed in connection with FIG. 1. Alternatively, the means for regulating electric current or power to the at least one solid state light source 114 may be dual driver circuitry which may have programmable setting of electrical current, pulse width modulation (PWM), a voltage divider etc. The dual driver circuitry may comprise multiple driving stages, e.g. one stage which performs the AC-DC conversion for all sub-engines and specific stages which perform the DC-DC conversion for each sub-engine to control the current to each sub-engine. As a further alternative, a single driver circuitry 108 may be provided and the adaptation is provided by the sub-engines, preferably by electronic switches rather than dissipating elements. The electronic switches should preferably be able to provide gradual control. The electronic switches may be a MOSFET or another type of transistor.

The method may comprise an additional step of adapting the power applied to each sub-engine 104,106 such that they reach the same temperature.

The component adapted to regulate electric current or power to the at least one solid state light source may comprise one or more sub-components. The component may comprise a temperature sensor and an integrated circuit (IC) which regulates the electric current or power to the at least one solid state light source by any known means. By way of example, a TMP01 low power programmable temperature controller from Analog Devices or a TC648 circuit from Microchip may be used in order to regulate the electric current or power to the solid state light source. The skilled addressee understands that minor modifications or additional electronic parts may be needed, e.g. for conversion between voltage regulation and current regulation.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination may not be used to an advantage.

The invention claimed is:

1. A lighting device comprising:

a split lighting engine with at least two thermally separated sub-engines, said lighting device further comprising an envelope and common driver circuitry connected to each sub-engine, the common driver circuitry adapted to provide an electric current or power to each sub-engine, wherein the sub-engines are arranged within the envelope along an optical axis of the lighting device, wherein each sub-engine comprises:

at least one solid state light source connected to the common driver circuitry; and a component connected to the common driver circuitry, the component adapted to regulate the electric current or power to the at least one solid state light source based on a thermal environment of each sub-engine, wherein each sub-engine adapts to and operates at a maximum temperature and light output based on the thermal environment.

2. A lighting device according to claim 1, wherein each sub-engine comprises a substrate arranged parallel to the optical axis of the lighting device, wherein the at least one solid state light source is mounted on the substrate.

3. A lighting device according to claim 1, wherein each sub-engine is spaced apart from other sub-engines by a predetermined distance.

4. A lighting device according to claim 3, wherein the predetermined distance is at least 5 mm.

5. A lighting device according to claim 1, wherein the component is a passive component adapted to passively regulate electric current or power to the at least one solid state light source.

6. A lighting device according to claim 1, wherein the component is an active component adapted to actively regulate electric current or power to the at least one solid state light source.

7. A lighting device according to claim 1, further comprising a shell made by additive manufacturing at least partially enclosing the sub-engines.

8. A lighting device according to claim 1, wherein the lighting device is a light bulb or a luminaire.

9. A method for operating a lighting device, which lighting device comprises a split lighting engine with at least two thermally separated sub-engines, said lighting device further comprising an envelope and common driver circuitry connected to each sub-engine, the common driver circuitry adapted to provide an electric current or power to each sub-engine, wherein the sub-engines are arranged within the envelope along an optical axis of the lighting device, wherein each sub-engine comprises at least one solid state light source, which method comprises:

regulating the electric current or power to the at least one solid state light source via a component connected to the common driver circuitry based on a thermal environment of each sub-engine and wherein each sub-engine adapts to and operates at a maximum temperature and light output based on the thermal environment.

10. A method for determining the orientation of a lighting device, the lighting device comprising:

a split lighting engine with at least two thermally separated sub-engines, wherein each sub-engine comprises:

at least one solid state light source; and a temperature sensor arranged on each sub-engine to measure the temperature of the sub-engine;

means for regulating electric current or power to the at least one solid state light source, so that the sub-engines are individually drivable based on their thermal environment; and an envelope, wherein the sub-engines are placed within the envelope along an optical axis of the lighting device;

the method comprises the steps of:

applying a substantially equal amount of power to each sub-engine;

measuring the temperature of each sub-engine to provide temperature data for each sub-engine; and determining the orientation of the lighting device based on the temperature data from each sub-engine and their respective placement along the optical axis.

* * * * *